US010842185B1

(12) United States Patent
Petrosian

(10) Patent No.: US 10,842,185 B1
(45) Date of Patent: Nov. 24, 2020

(54) TWO-IN-ONE SMOKING APPARATUS TO CLEAN TOBACCO PIPES AND TO REFILL TOBACCO PAPERS

(71) Applicant: Arbi Petrosian, Glendale, CA (US)

(72) Inventor: Arbi Petrosian, Glendale, CA (US)

( * ) Notice: Subject to any disclaimer, the term of this patent is extended or adjusted under 35 U.S.C. 154(b) by 366 days.

(21) Appl. No.: 15/826,473

(22) Filed: Nov. 29, 2017

(51) Int. Cl.

| | |
|---|---|
| ***A24F 9/04*** | (2006.01) |
| ***A24F 9/08*** | (2006.01) |
| ***A24F 9/02*** | (2006.01) |
| ***A24C 5/42*** | (2006.01) |

(52) U.S. Cl.
CPC ..... *A24F 9/04* (2013.01); *A24C 5/42* (2013.01); *A24F 9/02* (2013.01); *A24F 9/08* (2013.01)

(58) Field of Classification Search
CPC ..... A24F 9/00; A24F 9/02; A24F 9/06; A24F 9/08; A24F 9/04; A24C 5/42
USPC ..... 131/242, 243
See application file for complete search history.

(56) References Cited

U.S. PATENT DOCUMENTS

| | | | | | |
|---|---|---|---|---|---|
| 865,547 | A * | 9/1907 | Walker | A24F 9/02 | 131/243 |
| 1,019,028 | A * | 3/1912 | Dodge | A24F 9/02 | 131/243 |
| 2,256,848 | A * | 9/1941 | Pokorny | A24F 9/02 | 131/243 |
| 2,294,133 | A * | 8/1942 | Schwalbe | A24F 9/08 | 131/243 |
| 2,790,448 | A * | 4/1957 | Bock | A24F 9/04 | 131/243 |
| 2,894,515 | A * | 7/1959 | Wismer, Jr. | A24F 9/04 | 131/243 |
| 3,263,690 | A * | 8/1966 | Buckley | A24F 9/02 | 131/243 |
| 3,672,374 | A | 6/1972 | Mancuso | | |
| 3,814,109 | A | 6/1974 | Patton | | |
| 3,853,132 | A | 12/1974 | Patton | | |
| 4,043,348 | A * | 8/1977 | Kanady | A24F 9/02 | 131/243 |
| 4,044,807 | A * | 8/1977 | Swainson | A24F 9/02 | 131/243 |
| 4,600,022 | A | 7/1986 | Pierce, Jr. | | |
| 8,291,917 | B2 | 10/2012 | Sweeney | | |
| 9,706,795 | B2 * | 7/2017 | Boring | A24F 9/08 | |
| 2015/0164135 | A1 | 6/2015 | Boring | | |
| 2017/0150752 | A1 | 6/2017 | Healy et al. | | |

FOREIGN PATENT DOCUMENTS

| | | | | |
|---|---|---|---|---|
| FR | 2326155 A * | 10/1975 | ..... | A24F 9/00 |

* cited by examiner

*Primary Examiner* — Alex B Efta
(74) *Attorney, Agent, or Firm* — Thomas I. Rozsa

(57) ABSTRACT

An apparatus having a two-in-one pipe cleaner and tobacco paper refiller. The two portions of the two-in-one pipe cleaner and tobacco paper refiller fit together for storage and safe keeping. The pipe cleaner portion has a rectangular-shaped base with a protruding cylindrical shaft ending in a rounded tip. The paper refiller portion also has a rectangular-shaped base that has a protruding cylindrical shaft with a flat distal end.

10 Claims, 6 Drawing Sheets

TWO-IN-ONE SMOKING APPARATUS TO CLEAN TOBACCO PIPES AND TO REFILL TOBACCO PAPERS

BACKGROUND OF THE INVENTION

1. Field of the Invention

The field of invention relates to the use of smoking tobacco and other products which are used as a substance for smoking. Specifically, the present invention relates to the field of products used to clean residue from a smoking apparatus after the tobacco has been smoked. The present invention also relates to the field of filling tobacco in consumable smoking apparatus.

2. Description of the Prior Art

The following 11 patents and published patent applications are the closest prior art known to the inventor.

1. U.S. Pat. No. 2,256,848 issued to J. J. Pokerorny on Sep. 23, 1941 for "Pipe Tool" (hereafter the "Pokerorny Patent");
2. U.S. Pat. No. 2,790,448 issued to Sidney W. Bock on Apr. 30, 1957 for "Pipe Smoking Accessory" (hereafter the "Bock Patent");
3. U.S. Pat. No. 2,894,515 issued to Eli F. Wismer, Jr. on Jul. 14, 1959 for "Pipe Pick And Tamper" (hereafter the "Wismer Patent");
4. U.S. Pat. No. 3,672,374 issued to Henry Mancuso on Jun. 24, 1970 for "Caddy For Holding Pipe Cleaners" (hereafter the "Mancuso Patent");
5. U.S. Pat. No. 3,814,109 issued to Edward Donald Patton on Jun. 4, 1974 for "Pipe Tool" (hereafter the "'109 Patton Patent");
6. U.S. Pat. No. 3,853,132 issued to Edward Donald Patton on Dec. 10, 1974 for "Pipe Tool" (hereafter the "'132 Patton Patent");
7. U.S. Pat. No. 4,044,807 issued to Ralph V. Swainson on Aug. 30, 1977 for "Pipe Tobacco Tamper And Method" (hereafter the "Swainson Patent");
8. U.S. Pat. No. 4,600,022 issued to Howard E. Pierce, Jr on Jul. 15, 1986 for "Composite Smoker's Kit" (hereafter the "Pierce Patent");
9. U.S. Pat. No. 8,291,917 issued to Andrew Sweeney on Oct. 23, 2012 for "Attachable Lighter Tool" (hereafter the "Sweeney Patent");
10. United States Published Patent Application No. 2015/0164135 to Amanda Boring on Jun. 18, 2015 for "Novel Pipe Cleaner" (hereafter the "Boring Published Patent Application");
11. United States Published Patent Application No. 2017/0150752 to Robert Andrew Healy et al. on Jun. 1, 2017 for "Portable Tamper Article" (hereafter the "Healy Published Patent Application").

The Pokerorny Patent discloses a shaft that is retained within the hand held portion of the pipe and which can be removed to clean the pipe.

The Bock Patent discloses a pipe smoker's accessory in the general form of a fountain pen or pencil.

The Wismer Patent discloses a pipe pick and tamper wherein the pipe pick and tamper may be operated with a single operating plunger with means to selectively project the pick or tamper.

The Mancuso Patent discloses an instrument shaped similar to a pen that acts a storage container for pipe cleaners.

The '109 Patton Patent discloses a knife, a pick, and a tampering surface all contained within a pen.

The '132 Patton Patent is a continuation of the previously discussed '109 Patton Patent and discloses a knife, a pick, and a tampering surface all contained within a pen.

The Swainson Patent discloses a pipe tamper for and a method of tamping tobacco in a pipe bowl.

The Pierce Patent discloses a composite smoker's kit for preparing a pipe or a cigar for smoking. Pierce Patent contains a blade that is rotatably hidden when not in use and can be rotated open for the purposes of cutting a cigar. The Pierce Patent is designed to slide over a lighter.

The Sweeney Patent discloses an attachable lighter tool having a clip slidably engaging the body of the lighter. When not in use, the tool conforms substantially against the body of the lighter and is out of the way. In use, a smoker slides the clip along the major axis of the lighter, exposing the implement for the servicing of the smoker's pipe.

The Boring Published Patent Application discloses: "The novel pipe cleaner may include a housing component providing an elongated tube that detachably secures a brush component on one end and a pick component on an opposing end. The brush component and the pick component may include elongated portions for scraping and cleaning the residue from a smoke pipe. The elongated portions can be simultaneously and interchangeably stored within the lumen of the elongated tube so as to facilitate the mess-free storage and portability of the novel pipe cleaner."

The Healy Published Patent Application discloses: "A portable tamper article is disclosed, including a non-flammable tamper device, and a retaining member secured to or integrated with the tamper device, said retaining member adapted to engage a portable device. Also disclosed is a portable tamper article, including a non-flammable retaining member, comprising a tamper device, wherein the retaining member is adapted to engage a portable device. Further disclosed is a combination lighter and tamper article, including a lighter and a retaining member comprising a tamper device, wherein the retaining member is adapted to engage the lighter."

SUMMARY OF THE INVENTION

The present invention is a two-in-one pipe cleaner and tobacco paper refiller. The two portions of the present invention two-in-one pipe cleaner and tobacco paper refiller fit together for storage and safe keeping. The pipe cleaner portion has a rectangular-shaped base with a protruding shaft that extends from one of the vertical surfaces that form the rectangular-shaped base. The protruding shaft is cylindrical in shape for a portion of its length and then tapers and ends in a rounded tip. The paper filler portion also has a rectangular-shaped base with a protruding shaft that extends from one of the vertical surfaces that form the rectangular-shaped base. The protruding shaft is cylindrical in shape for its entire length and ends in a flat transverse surface at its distal end. Each respective base has an interior longitudinal channel to receive a protruding shaft from an opposite base. The two protruding shafts are parallel and offset so that when each respective protruding shaft is in its respective longitudinal interior channel, both protruding shafts are concealed. An entrance to one of the interior channels includes a magnet to retain both protruding shafts in the closed condition.

It is an object of the present invention to provide a two-in-one pipe cleaner and tobacco paper refiller that is compact in size and safely and easily transportable. The paper filler portion entitled PAK for packing has an opening surrounded by circumferential surface at one end. This opening is designed to allow the present invention to attach to a key chain. The pipe cleaning portion entitled POK for the pipe cleaner has an opening surrounded by circumferential surface at one end. At least one of the openings is a magnet to retain the POK and PAK sections together.

It is also an object of the present invention to provide an opening and a corresponding longitudinal interior chamber within the PAK rectangular base to allow the cylindrical pointed shaft for the POK pipe cleaning shaft to fit into said longitudinal interior chamber. Similarly, it is also an object of the present invention to provide an opening and a corresponding longitudinal interior chamber within the POK rectangular base to allow the cylindrical shaft for the PAK pipe cleaner to fit into said longitudinal interior chamber.

It is an additional object of the present invention to have the directly opposite interior longitudinal chambers that accept each cylindrical shaft respectively aligned with respective longitudinal shaft.

It is a further object of the present invention to have a metal collar encircling a base of at least one cylindrical shaft with a magnet surrounding the opening of the longitudinal interior chamber into which the cylindrical shaft is inserted to retain the POK and PAK sections together in the closed condition.

It is a further object of the present invention for the respective interior outer surfaces of the POK and PAK sections to be aligned and touching each other when the present invention is in the closed position.

It is a further object of the present invention to provide a magnetic connection between the directly opposite transverse surfaces of the POK and PAK sections to be removably together during storage or when not in use. Other affixation means commonly known such as but not limited to press fit connections, snaps, and hook-and-loop fasteners are within the spirit and scope of this invention.

It is still a further object of the present invention to provide a two-in-one PAK pipe cleaner and POK tobacco paper refiller with a cylindrical shaft of the POK section being sufficiently strong to remove resin while still being light enough to carry on a key chain.

When used in this patent application including the specification, reference to the drawings and the claims of invention, "PAK", which in a fanciful spelling is spelled PAK in the drawings, and is the phonetic equivalent of "pack" is used to refer tobacco paper refillers. It is within the spirit and scope of the present invention for "tobacco paper" to include any cigarette, cigar, and any consumable wrapper into which a smoking substance is inserted and which tobacco paper is burned or otherwise consumed during the smoking process. It is also within the spirit and scope of the present invention for "tobacco" to include any substance which is smoked by a person using any smoking device". It is also within the spirit and scope of the present invention for "refiller" to include any device used to fill cigarette paper with tobacco or other smoking substances, fill cigars with smoking cigar tobacco, and fill other consumable papers with a substance to be smoked. The claims of invention are to be interpreted using this expanded definition for 'PAK", "tobacco", "tobacco paper" and "tobacco paper refiller"

When used in this patent application, POK, which in a fanciful spelling is spelled POK in the drawings, and is the phonetic equivalent of "poke", is used to refer a device to clean unburned residue of a smoking substance after a person has completed smoking through the pipe into which the smoking substance was inserted and prepared through appropriate means such as setting the smoking substance on fire or otherwise lighting it to enabling smoking. It is within the spirit and scope of the present invention for the word "pipe" to include any apparatus used to smoke a legal smoking substance including a smoking pipe, a hookah, or any other physical device used to smoke a legal substance. The claims of invention are to be interpreted using this expanded definition for 'POK". and "pipe cleaner".

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
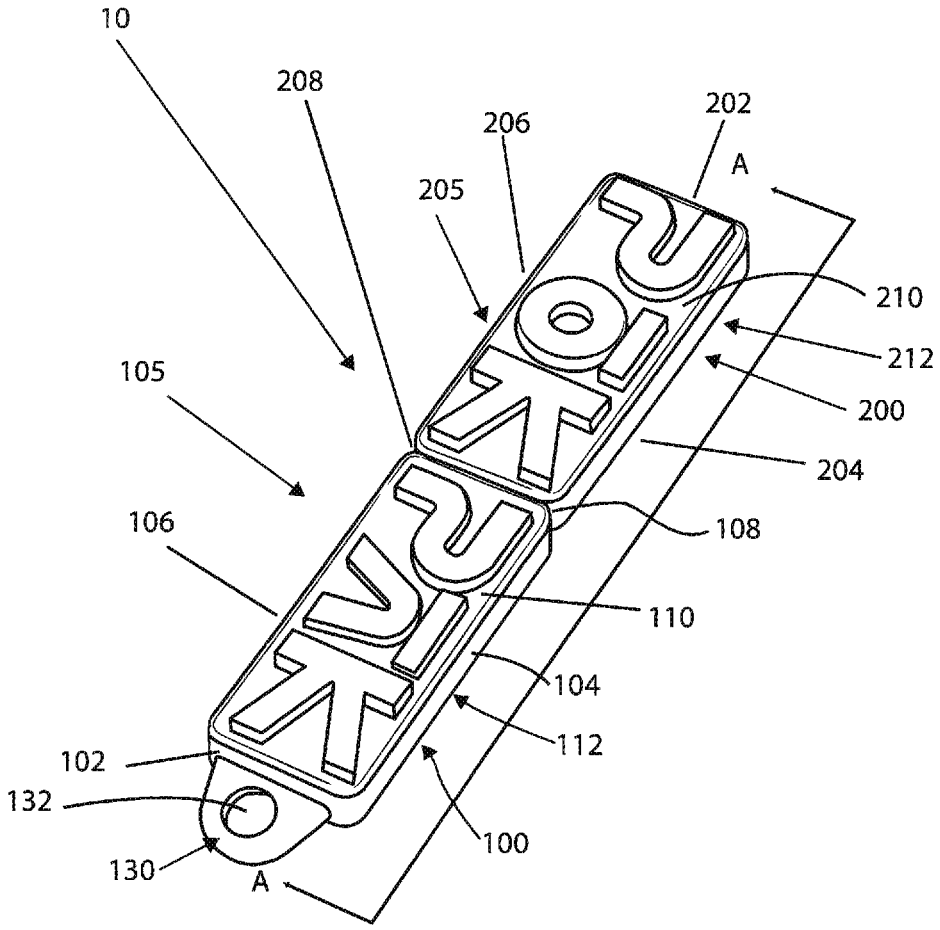
FIG. 1 is a front right side perspective view of the present invention two-in-one pipe cleaner and tobacco paper refiller in the closed condition.

Referring to FIG. 1, there is illustrated the present invention two-in-one pipe cleaner and tobacco paper refiller 10 which has two major components. Further including FIG. 2, the first major component is base rectangular-shaped portion 100, also referred to as PAK section. Further referring to FIG. 3, the second major component is rectangular base rectangular-shaped portion 200, also referred to as POK section.

Figure 2:
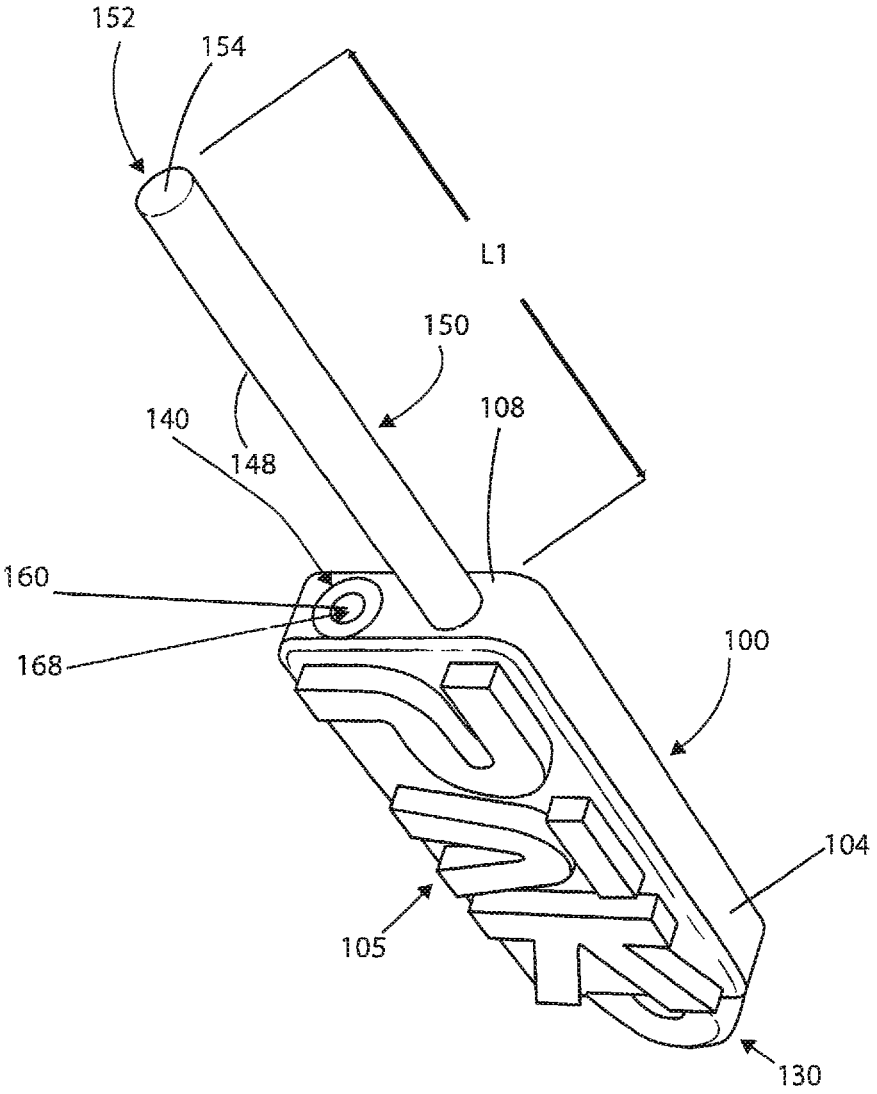
FIG. 2 is a top (relative to FIG. 1) front and right side perspective view of the refiller portion or PAK section of the present invention two-in-one pipe cleaner and tobacco paper refiller.

Referring to FIGS. 1 and 2, first base rectangular-shaped portion 100 or PAK section is a packer, defined as packer based on the function of the tool. The first base rectangular portion 100, also called PAK section, includes a PAK body 105 having a bottom transverse surface 102; a right sidewall surface 104; a left sidewall surface 106; a top transverse surface 108; a front surface 110; and a rear surface (better viewed in FIG. 5) 112.

Figure 3:
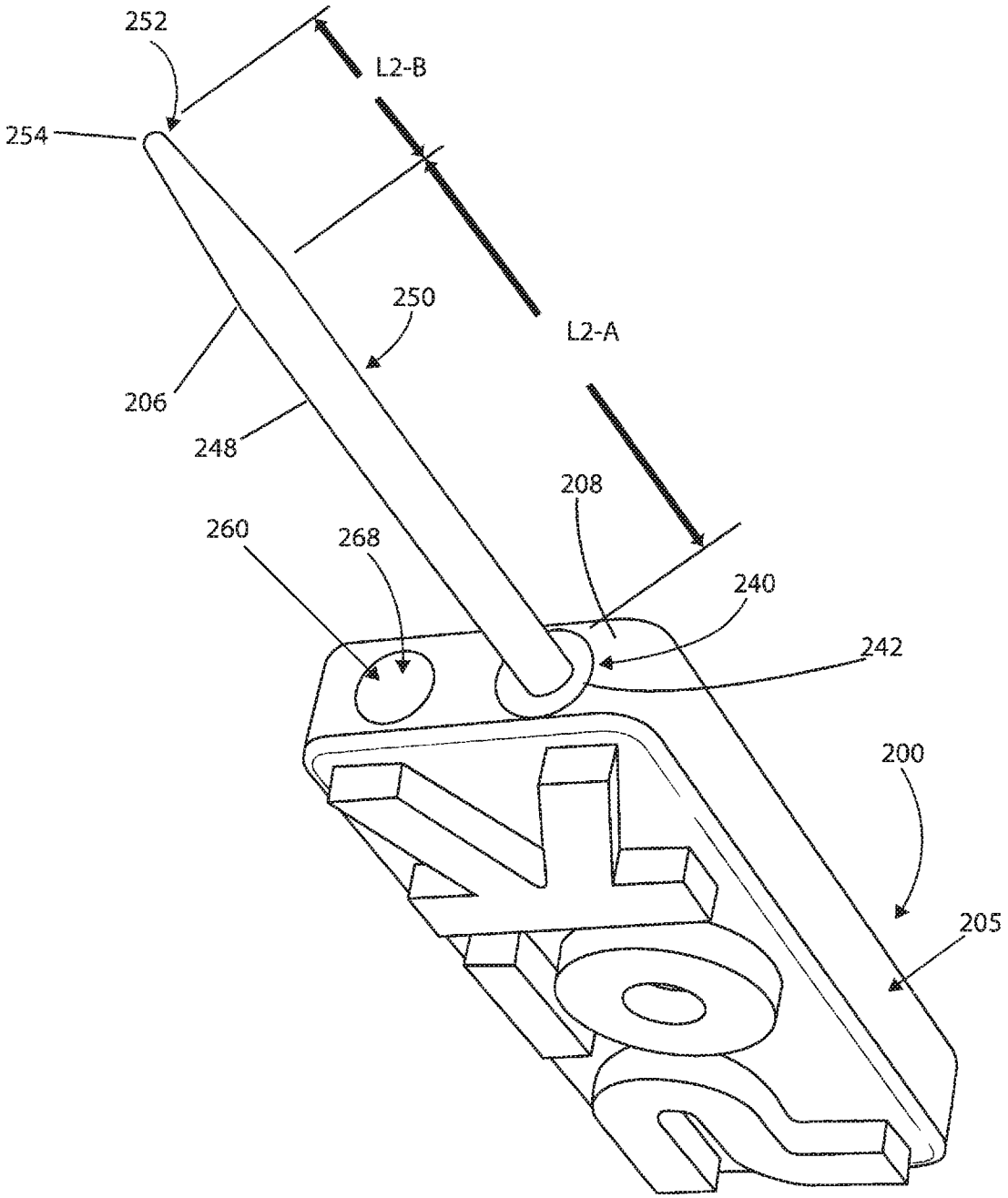
FIG. 3 is a bottom (relative to FIG. 1) front and right side perspective view of the pipe cleaning portion or POK section of the present invention two-in-one pipe cleaner and tobacco paper refiller.

Referring to FIGS. 1 and 3, second base rectangular-shaped portion 200 or POK section is a poker, defined as poker based on the function of the shaft. The second base rectangular portion 200, also called POK section, includes a POK body 205 having a top transverse surface 202; a left sidewall surface 204; a right sidewall surface 206; a bottom transverse surface 208; a front surface 210; and a rear surface (better viewed in FIG. 5) 212.

Referring to FIGS. 1 and 2, there is illustrated a bottom exterior surface 130 integrally formed with bottom transverse surface 102. The bottom exterior surface 130 includes a circular opening 132. The opening 132 of bottom transverse surface 130 facilitates a holder such as a key ring, key chain, etc. to be inserted through opening 132. While illustrated as a bottom transverse surface, it is within the spirit and scope of the present invention to instead have a top exterior surface integrally formed with top transverse surface 202 of POK section 200. A retaining opening could be part of such a top transverse surface.

Referring to FIG. 2, PAK section 100 includes a PAK protruding shaft 150 affixed into the interior body 170 (see FIG. 5) of PAK section 100 and extending outward from and perpendicular to top transverse surface 108. PAK protruding shaft 150 is cylindrical in shape with a longitudinal circumferential side surface 148 extending in a transverse flat surface 154 at its distal 152. The length of PAK perpendicular shaft from top transverse surface 108 to distal end 154 is "L1".

Referring to FIG. 3, POK section 200 includes a POK protruding shaft 250 affixed into the interior body 270 (see FIG. 5) of POK section 200 and extending outward from and perpendicular to bottom transverse surface 208. POK protruding shaft 250 is partially cylindrical in shape with a first POK shaft longitudinal circumferential side surface 248 extending from bottom transverse surface 208 to area 206 for a length "L2-A". Thereafter, POK protruding shaft 250 tapers to a distal end 252 having a rounded tip 254. The additional length from area 206 to the distal portion 252 has a length "L2-B".

Figure 4:
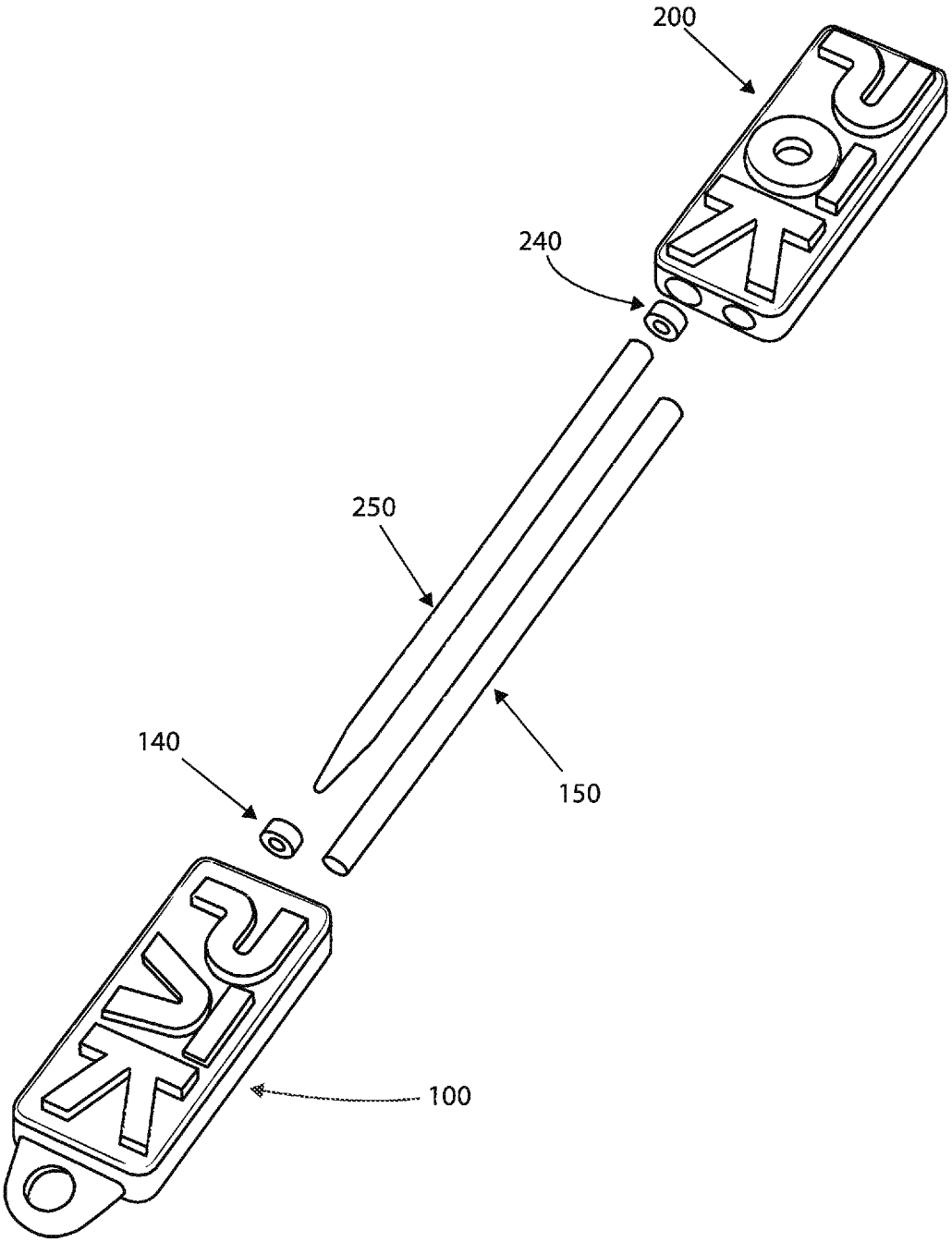
FIG. 4 is an exploded bottom, front, right side perspective view of the present invention two-in-one pipe cleaner and tobacco paper refiller illustrating the two rectangular bases, the two cylindrical shafts, and the two magnets.
Figure 5:
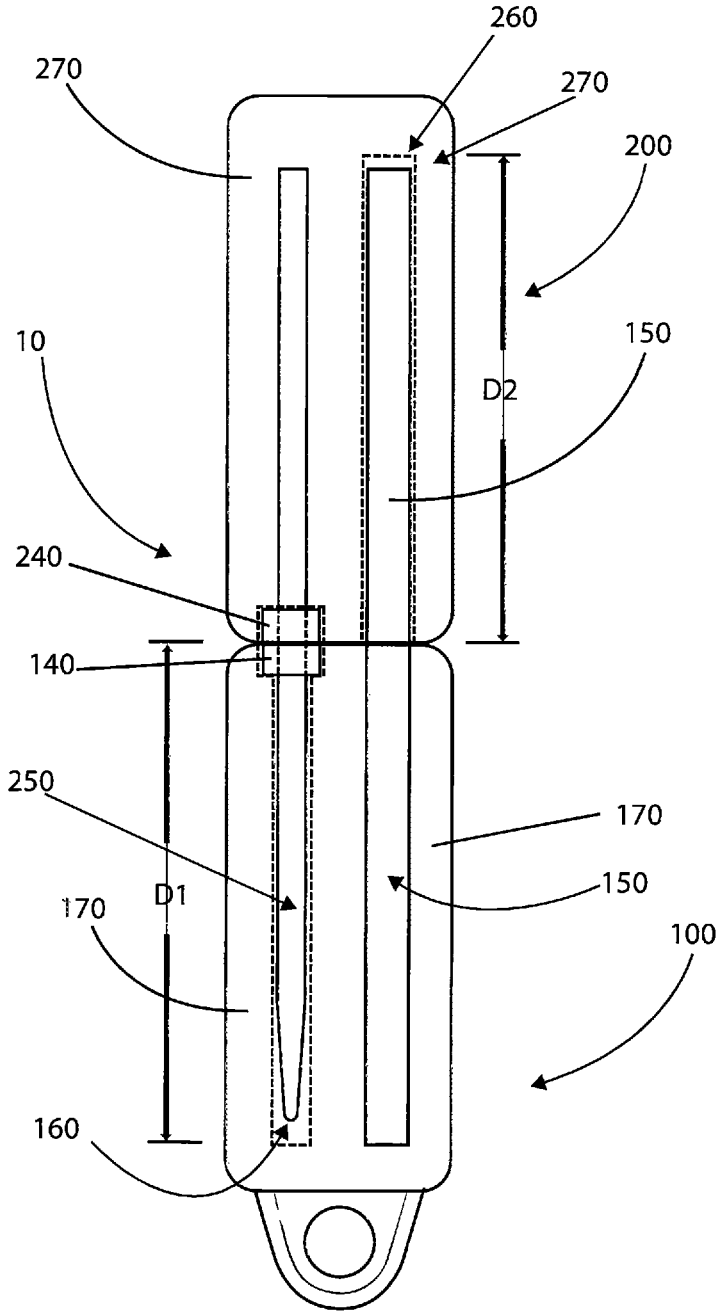
FIG. 5 is a cross-sectional view taken along A-A of FIG. 1 illustrating the present invention two-in-one pipe cleaner and tobacco paper refiller in the closed condition with the PAK cylindrical shaft extending into the POK rectangular base and the POK cylindrical shaft extending into the PAK rectangular base.

Referring to FIGS. 3, 4 and 5, POK section 200 has a POK interior longitudinal chamber 260 extending from circular opening 268 at bottom transverse surface 208 for a distance "D2:" into body 270 of POK section 200. PAK longitudinal shaft 150 is received in and retained in POK interior longitudinal chamber 260. Length 'L1" is shorter than distance "D2". One option is to include a cylindrical POK magnet 240 is partially embedded into cylindrical chamber 260 and partially extending transversely to and flush with bottom transverse surface 208. PAK shaft 150 is preferably made of metal. When the PAK section 100 and POK section 200 are fitted together as illustrated in FIGS. 1 and 5, PAK longitudinal shaft 150 is received and retained in POK interior longitudinal chamber 260 and the cylindrical POK magnet 240 retains PAK longitudinal shaft 150 in place and serves to retain PAK section 100 and POK section 200 together.

Referring to FIGS. 2, 4 and 5, PAK section 100 has a PAK interior longitudinal chamber 160 extending from circular opening 168 at top transverse surface 108 for a distance "D1" into body 170 of PAK section 100. POK longitudinal shaft 250 is received in and retained in PAK interior longitudinal chamber 160. Combined lengths L2-A and L2-B are shorter than distance "D1". Another option is to include a cylindrical PAK magnet 140 partially embedded into cylindrical chamber 160 and partially extending transversely to and flush with top transverse surface 108. POK shaft 250 is preferably made of metal. When the PAK section 100 and POK section 200 are fitted together as illustrated in FIGS. 1 and 5, POK longitudinal shaft 250 is received and retained in PAK interior longitudinal chamber 160 and the cylindrical PAK magnet 140 retains POK longitudinal shaft 250 in place and serves to retain PAK section 100 and POK section 200 together.

Preferably only one magnet, either PAK magnet 140 or POK magnet 240 is needed and it is within the spirit and scope of the present invention to have either a PAK magnet 140 or a POK magnet 240. It is also within the spirit and scope of the present invention to have both a PAK magnet 140 and a POK magnet 240 or alternatively no magnets.

Figure 6:
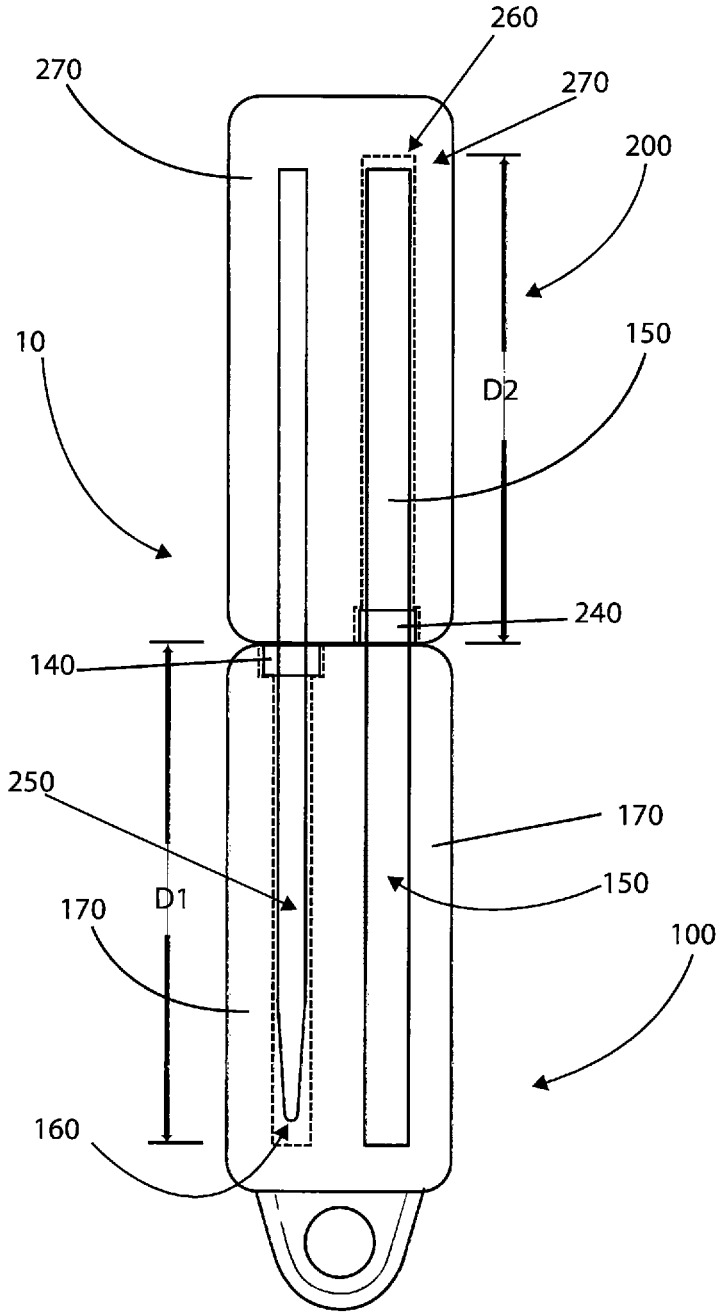
FIG. 6 is a cross-sectional view comparable to FIG. 5, but the POK section has one magnet in one column and a second magnet in an adjacent column.

Referring to FIG. 4, there is illustrated an exploded view of the present invention two-in-one pipe cleaner and tobacco paper refiller 10. PAK longitudinal shaft 150 and POK longitudinal shaft 250 are shown entirely removed from PAK section 100 and POK section 200. In the close condition, if both magnets are used, cylindrical PAK magnet 140 and cylindrical POK magnet 240 are adjacent to one another and retain PAK section 100 and POK section together. If only one of the magnets is used, it would still serve the same purpose of retaining PAK section and POK section together. FIG. 5 illustrates the PAK magnet 140 and the POK magnet 240 in aligned chambers. FIG. 6 illustrates the PAK magnet 140 and the POK magnet 240 in adjacent chambers.

Referring to FIG. 5, there is illustrated a cross sectional view of the present invention two-in-one pipe cleaner and tobacco paper 10 in the closed condition. This view illustrates how PAK longitudinal shaft 150 is retained within POK interior longitudinal chamber 260 and how POK longitudinal shaft 250 is retained within PAK longitudinal chamber 160.

By way of example, the present invention two-in-one pipe cleaner and tobacco paper refiller 10 has an overall combined length of approximately 2.5 inches in the closed condition. Each of the two major components, PAK base longitudinal rectangular-shaped portion 105 and POK base longitudinal rectangular-shaped base portion 205, without their respective shafts 150 and 250 are approximately one and one-quarter (1¼) inches each The length "L1" of POK longitudinal shaft is slightly less than one and one-quarter (1¼) inch. The length "L2-A" combined with "L2-B" of PAK longitudinal shaft is slightly less than one and one-quarter (1¼) inch.

In use, PAK section 100 and POK section 200 are separated. PAK base section 100 is held by hand, or at least two fingers, and the flat transverse distal surface 154 is used to pack the tobacco. POK base section 205 is held by a hand or at least two fingers and rounded tip 254 is used to scrape tobacco resident out of the pipe.

Of course the present invention is not intended to be restricted to any particular form or arrangement, or any specific embodiment, or any specific use, disclosed herein, since the same may be modified in various particulars or relations without departing from the spirit or scope of the claimed invention herein above shown and described of which the apparatus or method shown is intended only for illustration and disclosure of an operative embodiment and not to show all of the various forms or modifications in which this invention might be embodied or operated.

What is claimed is:

1. An apparatus comprising:

a. a two-in-one pipe cleaner and tobacco paper refiller having two major components, a PAK section and a POK section;

b. said PAK section including a PAK base formed in a rectangular-shaped body having a bottom transverse surface, a right sidewall surface, a left sidewall surface, a top transverse surface, a front surface and a rear surface;

c. said POK section including a POK base formed in a rectangular-shaped body having a bottom transverse surface, a right sidewall surface, a left sidewall surface, a top transverse surface, a front surface and a rear surface;

d. said PAK section including a PAK protruding shaft affixed into an interior body of said PAK base and extending outward from and perpendicular to the top transverse surface of said PAK base, said PAK protruding shaft is cylindrical in shape with a longitudinal circumferential sidewall extending to a transverse flat surface at a distal end of the PAK protruding shaft;

e. said POK section including a POK protruding shaft affixed into an interior body of said POK base and extending outward from and perpendicular to the bottom transverse surface of said POK base, said POK protruding shaft is partially cylindrical in shape with a first POK shaft longitudinal circumferential sidewall portion extending from the bottom transverse surface for a POK first length and continuing to a tapering sidewall portion for a POK second length to a distal end having a distal tip, the combined POK first length and POK second length being the POK protruding shaft length;

f. said POK base including a POK interior longitudinal chamber extending from a circular opening at the POK bottom transverse surface into a POK body in POK base for first POK interior longitudinal chamber length being longer than said PAK protruding shaft length;

h. said PAK base including an interior longitudinal chamber extending from a circular opening at the PAK top transverse surface into a PAK body in PAK base for first PAK interior longitudinal chamber length being longer than said PAK protruding shaft length;

i. said PAK protruding shaft aligned with and removably retained within said POK interior longitudinal chamber and POK protruding shaft aligned with and removably retained within said PAK interior longitudinal chamber and said POK top transverse surface is adjacent said PAK bottom transverse surface; and j. in an opened condition, said POK section including said POK base and said POK protruding longitudinal shaft separated from said PAK section including said PAK base and said PAK protruding longitudinal shaft.

2. The apparatus in accordance with claim 1, further comprising:

a. a POK magnet partially embedded into POK cylindrical chamber and partially extending transversely to and partially extending out of said bottom transverse surface of said POK base; and b. said PAK longitudinal shaft made of metal material attracted by said POK magnet.

3. The apparatus in accordance with claim 1, further comprising:

a. a PAK magnet partially embedded into PAK cylindrical chamber and partially extending transversely to and partially extending out of said top transverse surface of said POK base; and b. said POK longitudinal shaft made of metal material attracted by said PAK magnet.

4. The apparatus in accordance with claim 1, further comprising:

a. a POK magnet partially embedded into POK cylindrical chamber and partially extending transversely to and partially extending out of said bottom transverse surface of said POK base; and b. said PAK longitudinal shaft made of metal material attracted by said POK magnet;

c. a PAK magnet partially embedded into PAK cylindrical chamber and partially extending transversely to and partially extending out of said top transverse surface of said POK base; and d. said POK longitudinal shaft made of metal material attracted by said PAK magnet.

5. The apparatus in accordance with claim 1, further comprising: a bottom exterior surface integrally formed with said bottom transverse surface, said bottom exterior surface including a circular opening which facilitates a retaining object extending through the circular opening, the retaining object selected from group consisting of a key ring and a key chain.

6. An apparatus comprising:

a. a two-in-one pipe cleaner and tobacco paper refiller having two major components, a PAK section and a POK section;

b. said PAK section including a PAK base having at least a body with a bottom transverse surface and a top transverse surface;

c. said POK section including a POK base having at least a body with a bottom transverse surface and a top transverse surface;

d. said PAK section including a PAK protruding shaft affixed into an interior body of said PAK base and extending outward from and perpendicular to the top transverse surface of said PAK base and extending to a flat distal end;

e. said POK section including a POK protruding shaft affixed into an interior body of said POK base and extending outward from and perpendicular to the bottom transverse surface of said POK base and extending to a tapered tip distal ends;

f. said POK base including a POK interior longitudinal chamber extending from an opening at the POK bottom transverse surface into a POK body in POK base for a first POK interior longitudinal chamber length being longer than a length of said PAK protruding shaft;

g. said PAK base including a PAK interior longitudinal chamber extending from an opening at the PAK top transverse surface into a PAK body in PAK base for first PAK interior longitudinal chamber length being longer than a length of said POK protruding shaft;

h. said PAK protruding shaft aligned with and removably retained within said POK interior longitudinal chamber and said POK protruding shaft aligned with and removably retained within said PAK interior longitudinal chamber and said POK top transverse surface is adjacent said PAK bottom transverse surface; and i. in an opened condition, said POK section including said POK base and said POK protruding longitudinal shaft separated from said PAK section including said PAK base and said PAK protruding longitudinal shaft.

7. The apparatus in accordance with claim 6, further comprising:

a. a POK magnet partially embedded into POK interior longitudinal chamber and partially extending transversely to and partially extending out of said bottom transverse surface of said POK base; and b. said PAK longitudinal shaft made of metal material attracted by said POK magnet.

8. The apparatus in accordance with claim 6, further comprising:

a. a PAK magnet partially embedded into PAK cylindrical chamber and partially extending transversely to and partially extending out of said top transverse surface of said POK base; and b. said POK longitudinal shaft made of metal material attracted by said PAK magnet.

9. The apparatus in accordance with claim 6, further comprising:

a. a POK magnet partially embedded into POK cylindrical chamber and partially extending transversely to and partially extending out of said bottom transverse surface of said POK base; and b. said PAK longitudinal shaft made of metal material attracted by said POK magnet;

c. a PAK magnet partially embedded into PAK cylindrical chamber and partially extending transversely to and partially extending out of said top transverse surface of said POK base; and d. said POK longitudinal shaft made of metal material attracted by said PAK magnet.

10. The apparatus in accordance with claim 6, further comprising: a bottom exterior surface integrally formed with said bottom transverse surface, said bottom exterior surface including a circular opening which facilitates a retaining object extending through the circular opening, the retaining object selected from group consisting of a key ring and a key chain.

* * * * *